United States Patent [19]

Yanagisawa et al.

[11] Patent Number: 4,840,146

[45] Date of Patent: Jun. 20, 1989

[54] MULTIPLE THROTTLE MECHANISM FOR INTERNAL COMBUSTION ENGINES

[75] Inventors: Shozo Yanagisawa, Toukai; Sigeo Tamaki; Isamu Ishizawa, both of Katsuta, all of Japan

[73] Assignee: Hitachi, Ltd., Tokyo, Japan

[21] Appl. No.: 190,659

[22] Filed: May 5, 1988

[30] Foreign Application Priority Data

May 11, 1987 [JP] Japan ..... 62-112316

[51] Int. Cl.[4] ..... F02B 75/18

[52] U.S. Cl. ..... 123/52 MB; 123/52 MC

[58] Field of Search ..... 123/52 M, 52 MB, 52 MC, 123/52 MV, 308, 432

[56] References Cited

U.S. PATENT DOCUMENTS

| | | | |
|---|---|---|---|
| 3,664,316 | 5/1972 | Garcea | 123/52 MB |
| 4,253,432 | 3/1981 | Nohira et al. | 123/52 M |
| 4,520,775 | 6/1985 | Nakamura | 123/52 M |
| 4,660,530 | 4/1987 | Sugiyama et al. | 123/52 MB |

FOREIGN PATENT DOCUMENTS

| | | | |
|---|---|---|---|
| 0182223 | 5/1986 | European Pat. Off. | 123/52 M |
| 0150512 | 11/1979 | Japan | 123/52 MB |
| 0155220 | 9/1983 | Japan | 123/52 MB |
| 0088862 | 5/1985 | Japan | 123/52 MB |

*Primary Examiner*—David A. Okonsky

*Attorney, Agent, or Firm*—Antonelli, Terry & Wands

[57] ABSTRACT

A multiple throttle mechanism comprises a pair of intake manifold blocks separated from each other and each having two or more parallel passages formed therethrough and a wall portion separating thereby the adjacent parallel passages, the parallel passages each being a part of each of the intake manifold passages communicating with respective engine cylinders, and a pair of throttle shafts arranged in an axial direction, each crossing the parallel passages, passing through a through hole formed in the wall portion of the intake manifold block and supported on the intake manifold block, the throttle valves being mounted on the throttle shafts so that the throttle valves are operated simultaneously to control the cross sectional area of each of the parallel passage. The multiple throttle mechanism further comprises air gaps formed between an inner circumference of the through holes and an outer circumference of the shafts to provide an initial air flow.

6 Claims, 5 Drawing Sheets

MULTIPLE THROTTLE MECHANISM FOR INTERNAL COMBUSTION ENGINES

Background of the Invention

This invention relates to a throttle mechanism in a multiple cylinder engine and, more particularly, to a multiple throttle mechanism which has air control throttle valves provided in intake manifold passages that introduces air into respective cylinders.

In a multiple throttle mechanism for internal combustion engines as disclosed in the Japanese Patent Laid-Open No. 28038/1984, a shaft on which throttle valves are mounted passes through the intake manifold passages and is supported by two bearings for each the intake manifold passage, so that eight bearings are required for a four-cylinder engine and twelve for a six-cylinder engine.

In this conventional multiple throttle mechanism with the above structure, a large frictional resistance is caused on the bearing, so that the multiple throttle mechanism requires large throttle valve drive force and cannot be put to practical use.

Further in this multiple throttle valve mechanism, variations in a flow rate of air flowing in each the manifold passage take place.

The throttle valves each are provided with an air bleed hole or notch to obtain a certain amount of initial air flow and thereby minimize variations in the air flow rate during idling.

The throttle valve requires a special machining to provide the initial air flow rate and this deteriorates the manufacturing efficiency.

SUMMARY OF THE INVENTION

An object of this invention is to reduce the bearing friction acting upon a throttle shaft thereby to minimize the force required for driving throttle valves, and reduce variation in flow rate of air flowing respective engine cylinders during idling of the engine.

Another object of this invention is to provide a multiple throttle mechanism which can drive a plurality of throttle valves with minimized driving force and provide respective manifold passages with an initial air flow rate without performing an additional special machining on the throttle mechanism.

The present invention is characterized by providing a plurality of manifold blocks each of which has two or more intake manifold passages that go through one block to reduce the number of walls between the adjacent intake manifold passages and therefore the number of bearings, providing supporting throttle valves bearings only in the intake manifold block walls situated at both ends of the shaft, loosely inserting the shaft through holes in the walls that separate the adjacent intake manifold passages.

Further, the present invention is characterized by providing two or more intake manifold passages that go through one block to reduce the number of walls between the adjacent intake manifold passages and therefore the number of bearings, providing supporting throttle valves bearings only in the intake manifold block walls situated at both ends of the shaft, loosely inserting the shaft through holes in the walls that separate the adjacent intake manifold passages and providing air gaps between the shaft and the inner circumference of the holes to obtain the initial air flow rate thereby obtaining desired fuel air ratio during idling of the engine. The initial air flow rate is an air flow rate necessary to attain the revolution number of the engine for idling.

Description of the Invention

Figure 2:
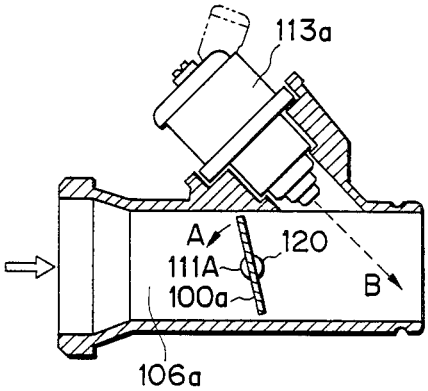
FIG. 2 is a sectional view taken along line II—II of FIG. 3.
Figure 3:
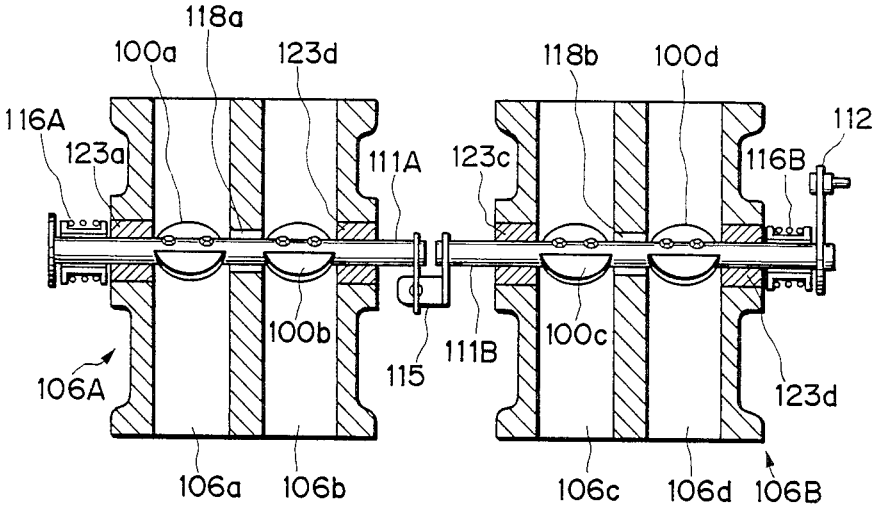
FIG. 3 is a partial enlarged cross-sectional view of FIG. 1.

One embodiment of this invention will now be described by referring to FIGS. 1 through 3.

Figure 1:
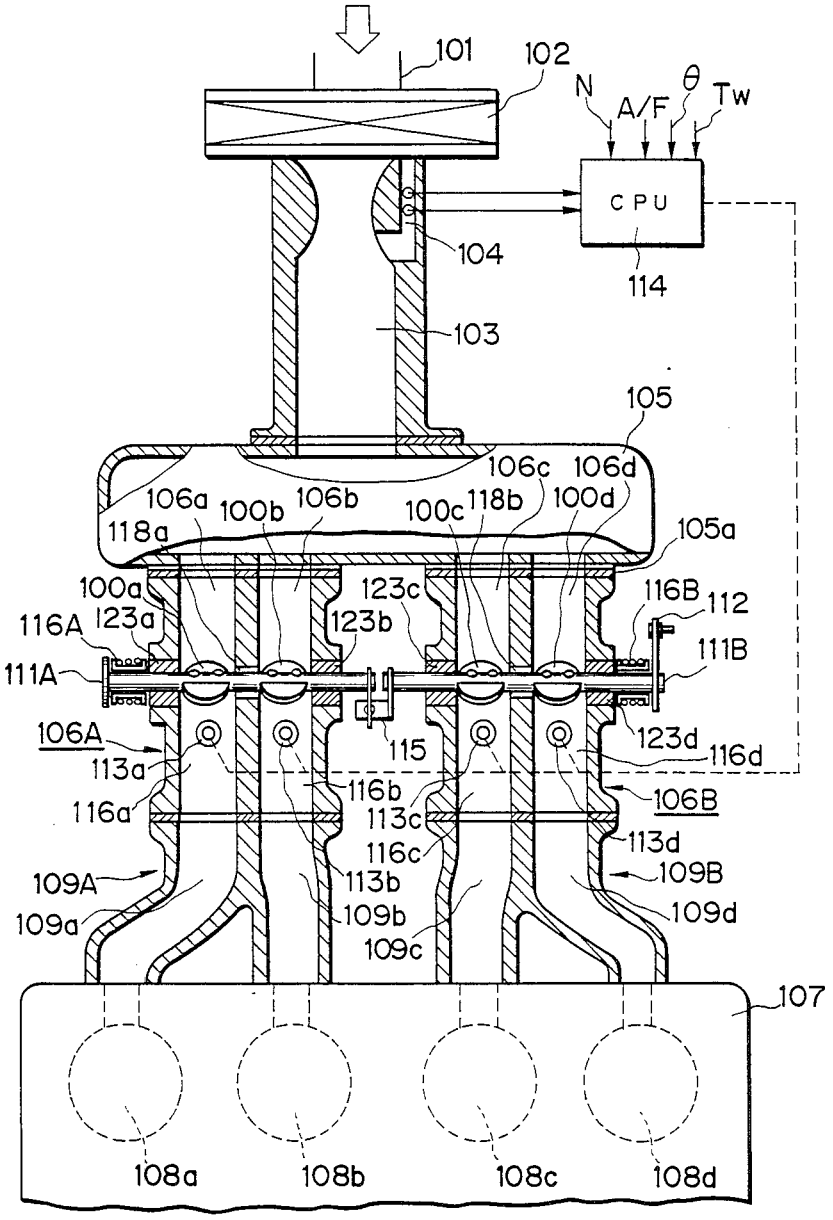
FIG. 1 is a cross-sectional view of a multiple throttle mechanism for a four-cylinder internal combustion engine which represents one embodiment of this invention.

FIG. 1 shows the structure of a fuel injection type multiple cylinder engine. Reference numeral 101 designates an air cleaner and sucked air is cleaned by a cleaner element 102. A main air intake passage 103 has a hot wire type air flow meter 104 installed in a bypass passage ina venturi portion. The main air intake passage 103 is connected to a distribution chamber 105 at a downstream end thereof. The distribution chamber 105 is connected to the upstream ends of the intake manifold passages 106*a* to 106*d* whose downstream ends communicate with the cylinders 108*a* to 108*d* of an engine block 107 through bent passages 109*a* to 109*d*. The intake manifold passages 106*a* to 106*d* are composed of straight passages 116*a* to 116*d* formed in intake manifold blocks 106A, 106B, and the bent passages 109*a* to 109*d* formed in connecting blocks 109A, 109B.

The straight portions 116*a* to 116*d* of the intake manifold passages 106*a* to 106*d* are provided with throttle valves 100*a* to 100*d*, respectively. The throttle valves 100*a* and 100*b* are mounted on a throttle shaft lllA that is supported on the intake manifold block 106A through bearing 123*a*, 123*b* and traverses the passages 106*a* and 106*b* at right angles. The throttle valves 100*c* and 100*d* are mounted on a throttle shaft lllB that is supported on the intake manifold block 106B through bearing 123*c*, 123*d* and traverses the straight passages 116*c* and 116*d* at right angles. These throttle valves 100*a* to 100*d* are securely fastened to the shafts lllA, lllB by set screws 120. The throttle shafts lllA and lllB are interconnected by a link mechanism 115, so that as the shaft lllB is turned by a throttle actuating member 112, the shaft lllA is also turned with the shaft lllB, causing the throttle valves 100*a* to 100*d* to turn in the direction of an arrow A in FIG. 2.

Injectors 113*a* to 113*d* are provided downstream of the throttle valves 100*a* to 100*d* in the straight portions 116*a* to 116*d* of the intake manifold passages 106*a* to 106*d*. The injectors 113*a* to 113*d* are of a known electronic control type and controlled by an electronic control device such as a microcomputer 114 to control the amount of fuel to be injected. As the air flow meter 104 measures the volume of air that flows through the main air intake passage 103, it supplies the computer 114 with an electric signal representing the measured air flow rate Based on the signal from the air flow meter 104, the-number-of-revolution signal N, A/F signal from an air-fuel ratio sensor not shown, throttle valve opening signal $\theta$, cooling water temperature signal Tw, and so on, the computer 114 calculates the amount of fuel to be injected and, according to the result of calculation, supplies control signals to each injector 113*a* to 113*d*. The injectors 113*a* to 113*d* then inject fuel into the intake manifold passages 106*a* to 106*d* according to the control signals from the computer 114.

Figure 8:
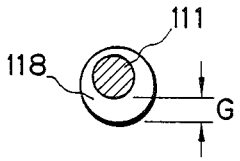
FIG. 8 is a sectional view showing a gap between a throttle shaft and a through hole.

A wall of the intake manifold block separating the straight passages 116*a* and 116*b* and a wall separating the straight passages 116*c* and 116*d* each are formed with a through-hole 118*a*, 118*b* through which the throttle shaft lllA lllB is loosely inserted. The same cross sectional area of a gap between the inner circumference of the through-hole and the outer circumference of the throttle shaft is formed for both shafts. As shown in FIG. 8, the gap G on the downstream side is made larger than the maximum deflection (described later) of the throttle shaft lllA lllB.

Now, the operation of the embodiment with the above structure will be explained in the following:

During engine operation, the air sucked through the air cleaner 101 into the main air intake passage 103 is distributed by the distribution chamber 105 to the intake manifold passages 106*a* to 106*d*, from which it is further led into the cylinders 108*a* to 108*d*.

The fuel is injected from the injectors 113*a* to 113*d* into the intake manifold passages 106*a* to 106*d* downstream of the throttle valves 100*a* to 100*d* according to the amount of air flowing through the main air intake passage 103. Thus, in the intake manifold passages 106*a* to 106*d*, the fuel is mixed with air downstream of the throttle valves 100*a* to 100*d* and the air-fuel mixture is introduced into the cylinders 108*a* to 108*d*.

The fuel amount variation among the intake manifold passages 106*a* to 106*d* is small because the amount of fuel injected into the intake manifold passages 106*a* to 106*d* is controlled by the computer 114 according to the amount of air sucked in through the main air intake passage 103. On the other hand, there are variations among the intake manifold passages 106*a* to 106*d* in the amount of air flowing through these passages. These are caused by variations in air distribution caused by the distribution chamber 105, variations in the opening degree of the throttle valves 100*a* to 100*d*, etc.

With this embodiment, however, since the air gaps 118*a* and 118*b* of the same sectional area are provided at the through-holes in the intake manifold block walls through which the throttle shafts are inserted, the amounts of air passing through the air gaps 118*a* and 118*b* are substantially equal among the intake manifold passages 106*a* to 106*d*.

In this type of engine, the amount of fuel injected into each of the intake manifold passages is controlled according to the total amount of air flowing through the main air intake passage. So, the variation in the amount of fuel injected into each of the intake manifold passages is small among these passages. However, the amount of air supplied into the intake manifold passages varies from one passage to another because of the air distribution variations, opening degree variations of the throttle valves, and assembly errors of the throttle valves to the throttle shaft.

This results in variations among the cylinders in the air-fuel ratio, which are significantly large especially when the throttle valves are closed as during idling.

However, with this embodiment the amount of air that flows through the air gaps 118*a* and 118*b* is substantially equal for all of the passages 106*a* to 106*d* and can be used at least as the initial air flow. This alleviates the adverse effects of the air distribution variations and of the throttle opening degree variations. As a result, the air amount variation among the passages and therefore the air-fuel ratio variation is reduced.

The air gaps 118*a* and 118*b* work effectively particularly when the throttle valves 100*a* to 100*d* are closed or when they are opened only to small degrees. Under such condition of the throttle valves a ratio of air flow rate from the air gap to air flow rate from the closed throttle valve is relatively large. This ratio decreases as the revolution number of the engine increases with the throttle valves being opened.

In the conventional multiple throttle mechanism the intake manifold passages are formed independently of each other, so that each passage requires a pair of bearings. And this means that a four-cylinder engine requires eight bearings and a six-cylinder engine twelve bearings.

Figure 7:
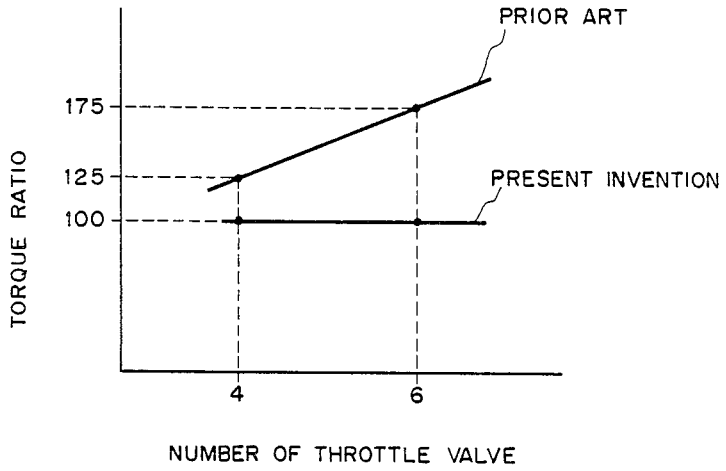
FIG. 7 is a diagram showing the comparison of required shaft driving torque between a conventional multiple throttle mechanism and the mechanism of this invention.

FIG. 7 shows the relationship between the number of bearings and the torque required to rotate the throttle shaft. It is noted that the rotating torque of the throttle shaft increases with the number of bearings. In an idling condition where the throttle valves are nearly closed, suction vacuum pressure acts upon the throttle valve pressing the shaft against the bearing, so that the torque required to turn the throttle shaft increases further.

According to this embodiment, two or more intake manifold passages as one set are formed in the intake manifold block in such a way that their straight portions are parallel. The block wall between the adjacent intake manifold passages is a common wall for the passages. Thus, as shown in FIGS. 1 and 3, with the four-cylinder engine which has two intake manifold blocks 106A and 106B each with two intake manifold passages, the number of bearings decreases to six. Furthermore, in this embodiment, the block wall that separates the adjacent passages in the same block is formed with the through-hole through which the shaft is loosely inserted, so as to keep the shaft out of contact with the wall. This further reduces the number of bearings to two, which are installed on both sides of each block, that is, there is only four in all on the engine. This in turn results in a significant reduction in the rotation torque of the shaft.

To keep the throttle shaft lllA, lllB from contacting the block wall when the throttle valves are subjected to suction vacuum pressure, the air gaps 118*a* and 118*b* at the through-holes through which the shafts are loosely inserted must be determined considering the diameter of the shaft, shaft length between the bearings, and the maximum suction vacuum pressure.

Figure 5:
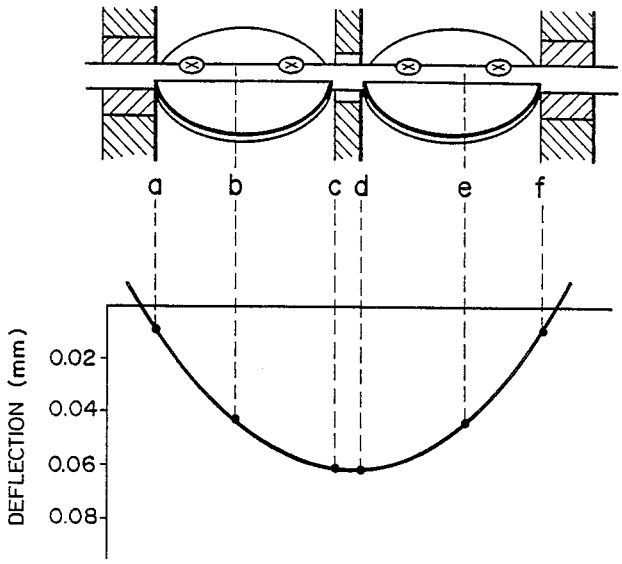
FIGS. 5 and 6 are diagrams showing the measured deflection of throttle shaft.

FIG. 5 shows the deflections of the shafts at various points measured when the throttle valves are fully closed at the revolution of 800 rpm during idling with the shaft diameter of 10 mm, the throttle valve diameter of 45 mm, and the shaft length (between a and f) of 97 mm.

The maximum deflection of about 0.06 mm occurred at the center wall.

Therefore, in FIG. 8 the air gap G downstream of the shaft, that is, between the lower end of the shaft (with respect to the air flow) and the through-hole circumference needs to be made greater than 0.06 mm. As explained earlier, when this air gap is used also as a gap to provide the initial air flow amount, the air gap downstream of the shaft should be set to more than 0.06 mm and the air gaps upstream of and at each side of the shaft should be set to magnitudes necessary to obtain the initial air flow amount. Maximum air gap is 0.12 mm for an engine of displacement of 2000 cc, for example. One of the methods to attain this purpose involves making the through-hole 118 eccentric with respect to the center axis of the shaft 111.

Although in this embodiment the block formed with the straight passages is directly secured to the distribution chamber 105 through a gasket 105*a*, it is possible to interpose a connecting pipe means between the block and the distribution chamber when bent passages are required between them.

Furthermore, it is possible to form the connecting blocks 109A and 109B of FIG. 1 integral with the intake manifold blocks 106A and 106B.

Figure 4:
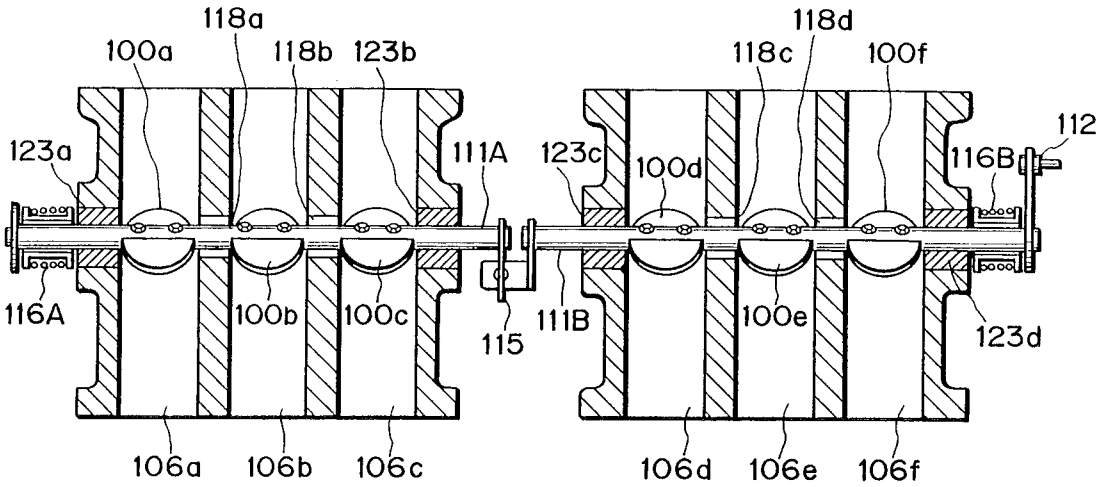
FIG. 4 is a partial vertical cross-sectional view of a multiple throttle mechanism for a six-cylinder internal combustion engine to which the invention applies.
Figure 6:
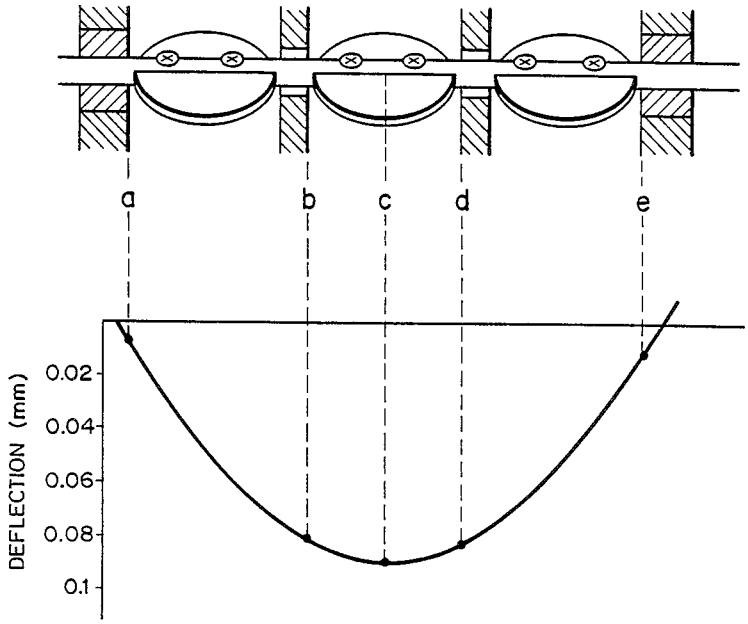

FIGS. 4 and 6 show a case where the straight portions of three intake manifold passages 106*a* to 106*f* are formed as one set in each intake manifold block for the six-cylinder engine. A pair of throttle shafts lllA, lllB each are provided with throttle valves 100*a* to 100*f* and supported by the intake manifold block through bearings 123*a* to 123*d*. The shafts, lllA, lllB are interlocked by a link mechanism 115 and driven by a throttle actuating member 112. The shafts lllA, 111B turns to an initial position by spring 116A, 116B.

In this case, for the shaft length (between a and e) of 150 mm, the maximum deflection of 0.09 mm occurred at the central point C. But since the maximum deflection at each intermediate wall is about 0.08 mm, the gap G may be set to 0.08 mm. In this example, the number of bearings is reduced from the ordinary 12 to four with a significant desirable effect on the shaft rotation torque.

While in the above embodiment the intake manifold passages 106*a* to 106*f* are formed in two blocks, it is possible to form four straight passages in one block for the four-cylinder engine or six straight passages in one block for the six-cylinder engine, provided the problems with the shaft and bearing strength have been resolved.

As explained above, this embodiment supports the throttle shaft on four bearings and therefore can keep the shaft torque constant regardless of the number of the cylinders as shown in FIG. 7.

If all the intake manifold passages are formed in one block and structured in a manner similar to this embodiment, the bearing is needed at only two locations with further reduction in the shaft torque.

In the above embodiments, an air gap is provided around the shaft extending through the block walls to secure the initial air flow and to allow for the shaft deflection. If, however, a separate means for securing the initial air flow is provided, the bearing may be installed in the block walls where the air gap is formed. In this case also, the number of bearings is smaller than that in the conventional structure and the effect of this invention can be had.

According to the invention as explained in the foregoing, the number of bearings mounted in the multiple throttle mechanism can be reduced, with the resultant reduction in the shaft torque. Further, since the openings in the block walls through which the throttle shaft of the multiple throttle mechanism is inserted are made larger than the shaft diameter, it is possible to provide the initial air flow rate without any additional special machining process and to provide fuel air mixture of a desirable fuel air ratio during idling of the engine.

What is claimed is:

1. A multiple throttle mechanism for internal combustion engines comprising a main air intake passage, a plurality of intake manifold passages connected to the downstream side of main air intake passage and communicating with engine cylinders, respectively, a plurality of throttle valves provided in said intake manifold passages, respectively, and fuel injectors having fuel injection holes opened to said intake manifold passages downstream of said throttle valves, respectively, characterized by a pair of intake manifold blocks separated from each other and each having at least two parallel passages formed therethrough and a wall portion separating thereby said adjacent parallel passages, said parallel passages each being a part of said intake manifold passage and having said injection hole;

a pair of throttle shafts arranged in an axial direction, said throttle shafts each crossing said parallel passages, passing through a through hole formed in said wall portion of said intake manifold block and supported on said intake manifold block, said throttle valves being mounted on said throttle shafts so that said throttle valves are operated simultaneously to control the cross sectional area of each said parallel passage; and means, including air gap defined between said through hole and said throttle shaft, for fluidly interconnecting said parallel passages in each of said intake manifold blocks and passing air from said main air intake passage into said parallel passages downstream of said throttle valves by bypassing said throttle valves, thereby providing desired fuel air ratio for each said engine cylinder during idling of the engine.

2. A multiple throttle mechanism for internal combustion engines as set forth in claim 1,wherein the number of said intake manifold blocks are two, the number of said parallel passages formed in one of said intake manifold blocks being one-half of that of said engine cylinders.

3. A multiple throttle mechanism for internal combustion engines as set forth in claim 2, wherein one of said shafts is provided with a throttle actuating mechanism for transmitting the depression of an accelerator pedal to said shaft so as to rotate said shaft having said link, and another link mechanism is provided between said shafts to transfer the rotation of one shaft to another.

4. A multiple throttle mechanism for internal combustion engines comprising a main air intake passage, a plurality of intake manifold passages connected to the downstream side of main air intake passage and communicating with engine cylinders, respectively, a plurality of throttle valves provided in said intake manifold passages, respectively, fuel injectors having fuel injection holes opened to said intake manifold passages downstream of said throttle valves, respectively, and a flow meter for detecting the flow rate of air sucked in through said main air intake passage, characterized by a pair of intake manifold blocks separated from each other and each having at least two parallel passages formed therethrough and a wall portion separating thereby said adjacent parallel passages, said parallel passages each being a part of said intake manifold passage and having said injection hole;

a pair of throttle shafts arranged in an axial direction, said throttle shafts each crossing said parallel passages, passing through a through hole formed in said wall portion of said intake manifold block and supported on said intake manifold block, said throttle valves being mounted on said throttle shafts so that said throttle valves are operated simultaneously to control the cross sectional area of each said parallel passage; and air gaps formed between an inner circumference of said through holes and an outer circumference of said shafts to provide an initial air flow.

5. A multiple throttle mechanism for internal combustion engines as set forth in claim 4, wherein said air gaps each are sufficient to allow free deflection of said shaft caused by and according to suction vacuum pressure acting on said throttle valves.

6. A multiple throttle mechanism for internal combustion engines as set forth in claim 5, wherein the air gaps are formed in such a way as to be larger on the downstream side of the shaft than on the upstream side.

* * * * *